US007313337B2

(12) United States Patent
Burry et al.

(10) Patent No.: US 7,313,337 B2
(45) Date of Patent: Dec. 25, 2007

(54) METHOD AND APPARATUS FOR SENSING AND CONTROLLING RESIDUAL MASS ON CUSTOMER IMAGES

(75) Inventors: Aaron M. Burry, West Henrietta, NY (US); Gerald M. Fletcher, Pittsford, NY (US); Eric S. Hamby, Fairport, NY (US); Peter Paul, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 324 days.

(21) Appl. No.: 11/249,699

(22) Filed: Oct. 13, 2005

(65) Prior Publication Data

US 2007/0086799 A1 Apr. 19, 2007

(51) Int. Cl.
*G03G 15/00* (2006.01)

(52) U.S. Cl. ..... 399/49; 399/129

(58) Field of Classification Search ..... 399/38, 399/42, 46, 49, 60, 107, 127, 129
See application file for complete search history.

(56) References Cited

U.S. PATENT DOCUMENTS 5,543,896 A 8/1996 Mestha
5,887,221 A 3/1999 Grace
5,903,797 A 5/1999 Daniels et al.
6,272,295 B1 8/2001 Lindblad et al.
6,694,109 B1 2/2004 Donaldson
7,054,568 B2 * 5/2006 Mizes et al. ..... 399/49
7,120,369 B2 * 10/2006 Hamby et al. ..... 399/49
7,236,711 B2 * 6/2007 Burry et al. ..... 399/49

* cited by examiner

*Primary Examiner*—Hoan Tran
(74) *Attorney, Agent, or Firm*—Duane C. Basch; Basch & Nickerson LLP

(57) ABSTRACT

Disclosed is a method and apparatus for sensing residual toner mass after transfer of a xerographic image, to facilitate the identification and characterization of different types of transfer defects. The technique employed utilizes a nominal residual mass signature, measured at the start of a job, in conjunction with subsequent residual mass signature, where the calculated difference between the nominal and subsequent signatures is used to indicate transfer defects and changes in transfer efficiency.

20 Claims, 6 Drawing Sheets

METHOD AND APPARATUS FOR SENSING AND CONTROLLING RESIDUAL MASS ON CUSTOMER IMAGES

CROSS-REFERENCE TO RELATED APPLICATIONS

U.S. patent application Ser. No. 11/094,454, for a FULL-WIDTH ARRAY SENSING OF TWO-DIMENSIONAL RESIDUAL MASS STRUCTURE TO ENABLE MITIGATION OF SPECIFIC DEFECTS, filed Mar. 31, 2005 by Aaron M. Burry et al. is hereby incorporated by reference in its entirety.

A method and apparatus is disclosed for sensing residual mass after transfer of a xerographic image, to facilitate the identification and characterization of different types of transfer defects. The technique employed utilizes a nominal residual mass per unit area (RMA) measured at the start of a job in conjunction with subsequent residual mass per unit area measurements, where the calculated difference between the nominal and follow-up residual mass per unit area is used to indicate transfer defects—such as a loss of transfer efficiency in a particular region of a document.

BACKGROUND AND SUMMARY

As disclosed in U.S. Pat. No. 5,887,221 to Grace; and U.S. Pat. No. 5,543,896 to Mestha; and U.S. Pat. No. 6,694,109 to Donaldson et al., the use of sensors in a xerographic engine to detect the toner mass levels on a photoreceptor, or other substrate, in a post-development position (detection of developed mass) is known. The use of sensors to detect residual toner mass levels post-cleaning device is also described in U.S. Pat. No. 6,272,295 to Lindblad et al. and U.S. Pat. No. 5,903,797 to Daniels et al. It is also known to measure the residual mass after transfer but before the cleaning device (post transfer residual mass).

Previous post-transfer residual mass sensors provided information about the average transfer efficiency and could enable limited closed loop control of a xerographic transfer system. For example, use of an Extended Toner Area Coverage (ETAC) sensor to measure residual mass during xerographic setup. The data from an ETAC sensor was used to adjust a transfer shield current set point to calibrate or adjust the system to obtain optimal performance prior to the submission of a customer's job.

The information provided by measuring the residual mass with a point sensor like an ETAC is limited to an average measurement of transfer performance. In addition, because a point sensor typically only measures the transfer efficiency at one isolated location in the cross-process direction, variations that occur across the photoreceptor or transfer belt are not detected by this type of sensor. Therefore, typical ETAC sensors provide only minimal or "gross" information that is employed to control transfer performance.

To overcome this problem, sensors containing arrays of optical sensing elements may be used to sense residual mass across a process direction. In many devices, the array of sensing elements provides information across an entire surface of the photoconductor, transfer belt/web or other surface where residual materials are collected after transfer. Such optical sensing array devices are termed full-width array (FWA) sensors. Such a method eliminates the problem of the point-sensing nature of ETAC residual mass sensors because the residual mass content of the entire image area of the photoreceptor can be captured. However, prior methods were still only concerned with measuring average transfer efficiency. Thus, although the residual mass per unit area value obtained may be more sensitive or accurate than prior point sensors (because it averages over a larger area), such sensing systems do not fully utilize the information that is available from the optical sensor.

The system and method disclosed herein address a need for a residual mass sensor that can sense and record a two-dimensional image or structure (i.e., signature) of the residual mass remaining on a surface after the transfer step in the xerographic process. There also is a need for a residual mass sensor and measurement analysis system/method that may be used to monitor the drift or deviation of residual mass over time (e.g., during a job) that uses the two-dimensional structure of the residual mass image to identify transfer defects that occur over the course of time, including those caused by changes in materials, environment, and print substrates.

One aspect disclosed herein is a closed-loop control system for a xerographic engine that improves print quality (PQ) performance and stability. The disclosed method and system, although directed to monitoring shifts in residual mass, may also take into account the quantified levels of specific print quality defects from the residual mass signature so that a customized and appropriate feedback correction can be made. More specifically, the residual mass signature is sensed after a nominal image is transferred and then monitored by comparison after subsequent image transfer. The difference in the residual mass signature of subsequent images, as compared to the nominal residual mass signature, can be used to detect drift or changes in the process, particularly over a common printing job.

Disclosed in embodiments herein is a method for identifying transfer defects in a xerographic system, comprising: sensing, after image transfer, a nominal residual mass structure on a surface corresponding to a portion of a document rendered within the xerographic system; sensing, after image transfer, a subsequent residual mass structure on the surface corresponding to a similar portion of the same document rendered within the xerographic system; analyzing the difference between the nominal residual mass structure and the subsequent residual mass structure; and detecting a transfer defect, or set of defects, based on the analysis of the residual mass structure.

Also disclosed in embodiments herein is a xerographic output device, comprising: a controller that receives an image signal representing an image to be printed; a photoconductive surface; a charging station that charges the photoconductive surface to a relatively high potential; an exposure station that receives image signals from the controller and records an electrostatic latent image on the photoconductive surface; a development station that deposits toner over the electrostatic latent image on the photoconductive surface to form a toner image; a transfer station that transfers the toner image from the photoconductive surface to a recording medium; a residual mass sensor that senses a nominal residual mass signature after image transfer and a subsequent residual mass signature, and a processor, that receives the nominal residual mass image and subsequent residual mass images and determines a difference between the nominal and subsequent residual mass images to indicate a transfer defect.

Further disclosed in embodiments herein is a method for identifying transfer defects in a xerographic system, comprising: receiving an image signal for rendering; charging a photoconductive surface; exposing the charged photoconductive surface to produce a latent image thereon; developing the latent image on the photoconductive surface; transferring the developed image to a substrate; sensing, after image transfer, a nominal residual mass structure on a surface corresponding to a portion of a document rendered within the xerographic system; repeating the steps above and then sensing, after image transfer, a subsequent residual mass structure on the surface corresponding to a similar portion of the same document rendered with the xerographic system; analyzing the difference between the nominal residual mass structure and the subsequent residual mass structure; and detecting, and possibly quantifying the level of, a transfer defect, or set of defects, based on the analysis of the residual mass structure.

BRIEF DESCRIPTION OF THE DRAWINGS

Exemplary embodiments will be described with reference to the drawings, wherein.

DETAILED DESCRIPTION

Figure 1:
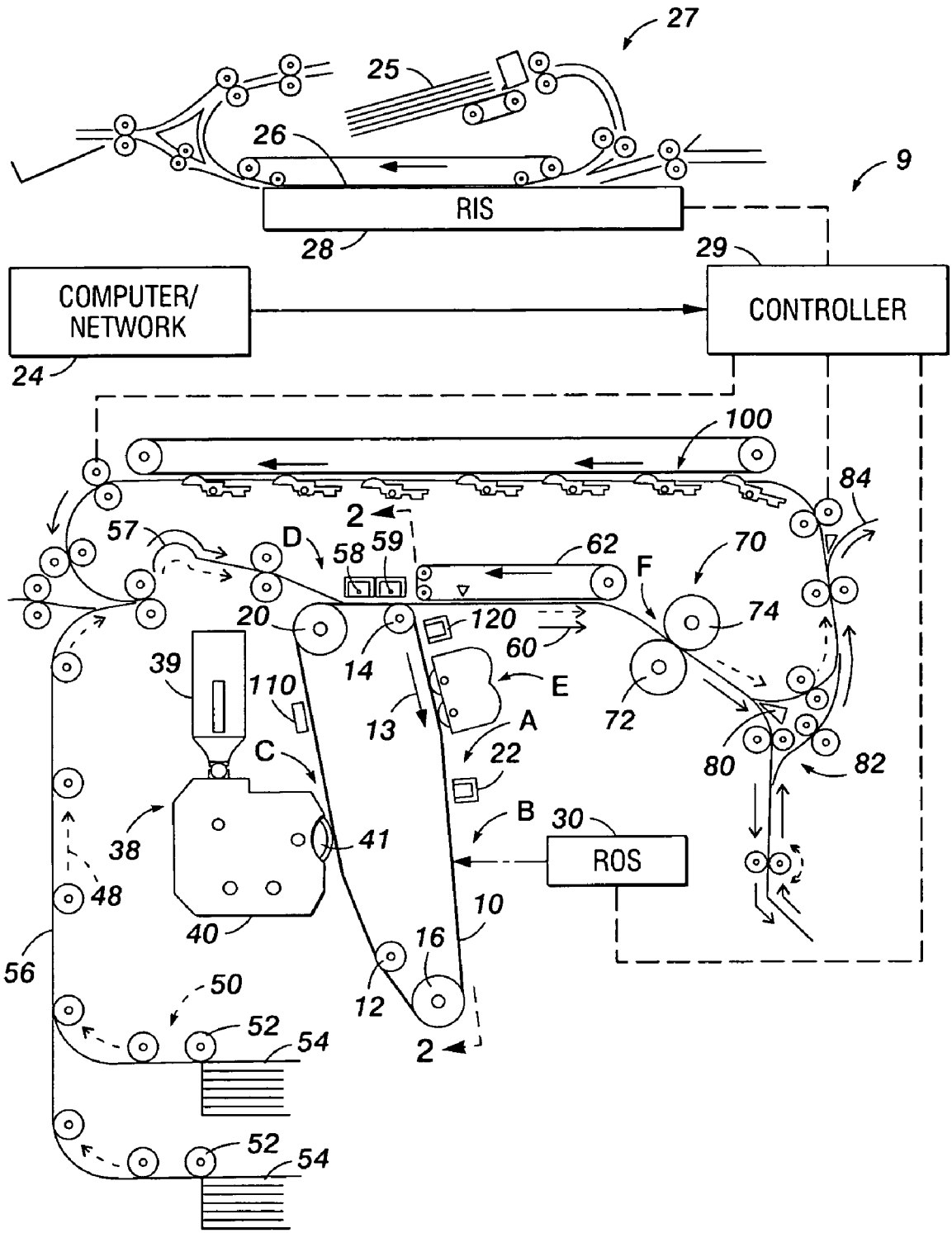
FIG. 1 is a schematic illustration of an exemplary xerographic system having a print engine and an optical sensor capable of residual mass sensing in a post-transfer location.

For a general understanding of the features of the disclosed system and method, reference is made to the drawings, which are for purposes of illustration and are not representative of size or scale. In the drawings, like reference numerals have been used throughout to identify identical elements.

When examining transfer performance by sensing the residual mass on a photoreceptor, prior methods utilized residual mass sensing and a suitable closed-loop control system to optimize transfer efficiency (or average residual mass levels) in the xerographic system. Because of the inability to discern between various types of transfer related defects, these prior methods were not completely effective at controlling the output of the transfer process. For example, to correct a problem with transfer induced point deletions, the transfer field would typically be reduced. However, to correct a problem with transfer induced mottle, the transfer field would typically be increased. As it is possible that both types of defects (mottle and point deletions) can exhibit the same average residual mass per unit area levels, known ETAC and other point-sensors that sense only average residual mass per unit area ($RMA_{avg}$) could not distinguish between various types of transfer defects. The following description first characterizes exemplary embodiments of the system and method and then describes in detail various features thereof.

Figure 2:
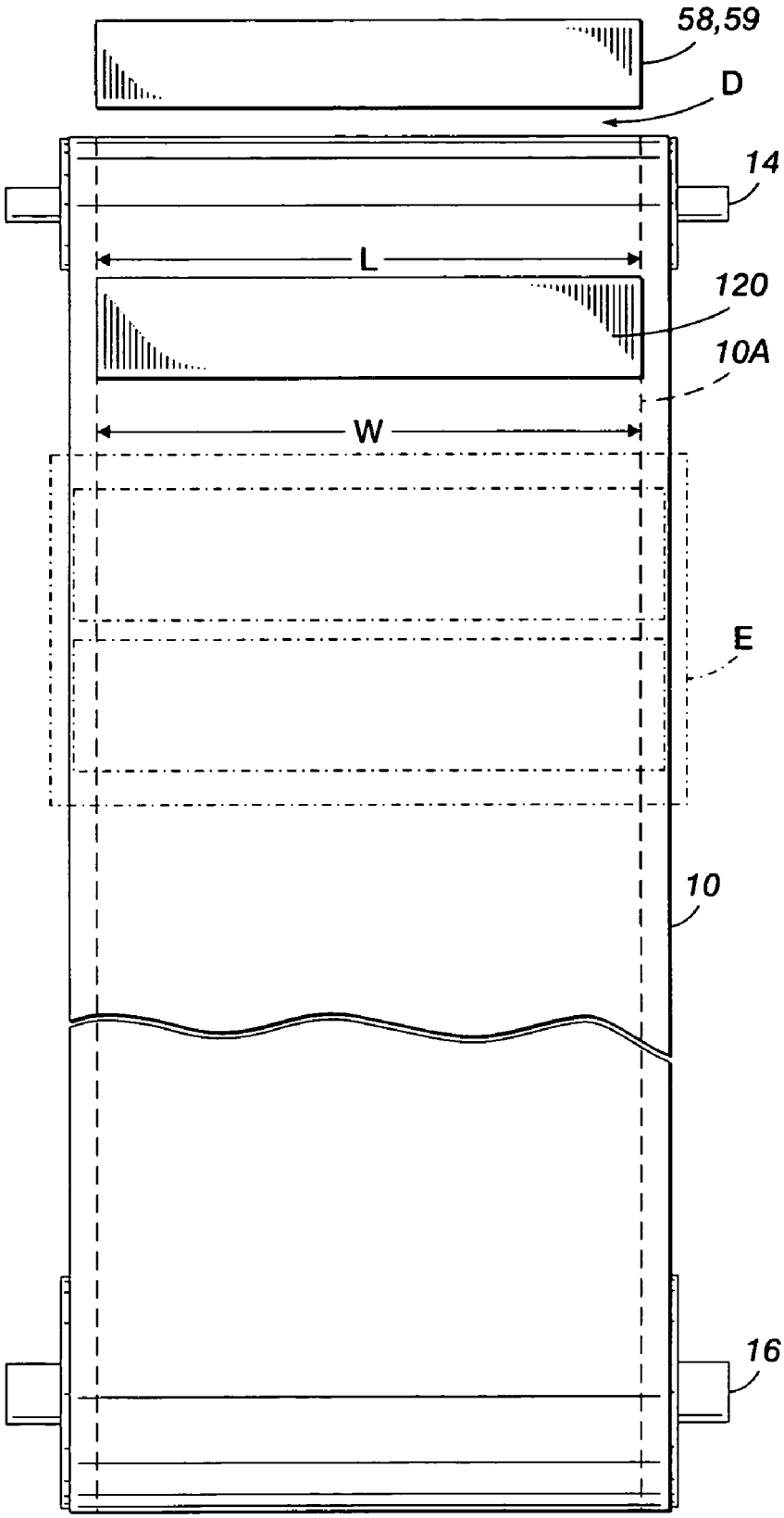
FIG. 2 illustrates a partial cross-sectional view of the xerographic print engine of FIG. 1 taken along lines 2-2 showing relevant details of the transfer station, photoconductive belt and residual mass sensor.

FIGS. 1 and 2 depict an exemplary xerographic or electrophotographic system 9 incorporating a two-dimensional residual mass sensor. It will become evident from the following discussion that the residual mass monitoring system and method disclosed is not specifically limited in its application to the particular embodiment depicted, but may be included in various printing systems, digital copiers and the like. In the digital copier embodiment, an original document 25 is positioned in a document handler 27 on a raster input scanner (RIS) indicated generally by reference numeral 28. RIS 28 contains document illumination lamps, optics, a mechanical scanning drive and a charge coupled device (CCD) or similar array for sensing light reflected from a surface of a document advanced to platen 26. The RIS captures an image of the entire original document and converts it to a series of rasterized scan lines that represent an image of the document. This rasterized image information is then transmitted to an electronic subsystem (ESS) or controller 29 that controls a raster output scanner (ROS) 30 as described below. As will be apparent, in addition to the RIS input, other sources of rasterized image information may include a network 24 or other image input devices.

Xerographic system 9 employs a photoconductor such as a drum or belt 10 for creating xerographic images. Preferably, the photoconductor 10 is made from a photoconductive material coated on a ground layer that is coated on an anti-curl backing layer. In the depicted embodiment, belt 10 moves in the direction of arrow 13 to advance successive portions sequentially through the various processing stations disposed about the path of movement thereof. Belt 10 is entrained about idler roller 12, stripping roller 14, tensioning roller 16 and drive roller 20. As drive roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform voltage or potential. At exposure station, B, modulated output generator, for example the raster output scanner (ROS), indicated generally by reference numeral 30 is operated in response to the output of controller or Electronic SubSystem (ESS) 29. The controller, having received the image signals representing a desired output image, processes these signals to convert them to a halftone rendition of the image which is then employed to drive or modulate the ROS and cause the selective exposure of regions of the photoconductive surface in a manner that is well known. ESS 29 is, in one embodiment, a self-contained, dedicated minicomputer.

The image signals transmitted to ESS 29 may originate from a RIS or network as described, thereby enabling the system 9 to serve as a remotely located printer for one or more computers. Alternatively, the system may serve as a dedicated printer for a high-speed computer. The signals from ESS 29, corresponding to the continuous tone image desired to be reproduced by the printing machine, are transmitted to ROS 30, which includes a laser or similar exposure mechanism. The ROS discharges the photoconductive belt to produce a latent electrostatic image thereon corresponding to the image received from ESS 29. As an alternative to a laser exposure device, ROS 30 may employ a linear array of Light Emitting Diodes (LEDs) arranged to illuminate the charged portion of photoconductive belt 10 on a raster-by-raster basis.

Once the latent electrostatic image has been produced on photoconductive belt 10, the belt advances to move the latent image to development station C. At station C toner, in the form of dry marking particles, is electrostatically attracted to the latent image. The latent image attracts toner particles from a scavengeless developer apparatus, resulting in a toner powder image being formed on the photoconductive surface of belt 10 (photoconductive surface 10 ). More specifically, a toner particle dispenser, indicated generally by the reference numeral 39, in response to a signal from controller 29, dispenses toner particles into a non-interactive development system, such as hybrid scavengeless developer (HSD; available from Xerox Corporation) system 40 of developer unit 38. Developer unit 38 comprises donor roll 41 that serves to facilitate the deposition of toner particles on the photoconductive surface 10.

Developer system 40 may alternatively comprise a non-interactive development system wherein a toner cloud is created in the development zone using an alternating current to generate the toner cloud, and where the electrostatic field associated with the latent image attracts toner from the toner cloud. The donor roll 41 may also comprise an electroded donor roll structure such as that disclosed in U.S. Pat. No. 5,360,940 to Hays.

With continued reference to FIG. 1, after the electrostatic latent image is developed, the developed image present on belt 10 advances to transfer station D. A substrate 48, such as plain paper, is advanced to a transfer station D by a substrate feeding apparatus 50. Preferably, substrate feeding apparatus 50 includes a feed roll 52 contacting the uppermost substrate of a sheet stack 54. Feed roll 52 rotates to advance the uppermost substrate from stack 54 into vertical transport 56. Vertical transport 56 directs the advancing substrate 48 of support material into registration transport 57, past image transfer station D, to receive an image from photoreceptor belt 10 in timed sequence where the developed toner image formed thereon contacts the advancing substrate 48 in a registered fashion at transfer station D.

Transfer station D includes a corona generating device 58 that sprays ions onto the back side of substrate 48. This attracts the toner powder image from photoconductive surface 10 to substrate 48. After transfer, substrate 48 continues to move in the direction of arrow 60 by way of belt transport 62, which advances substrate 48 past transfer device 58. A detack corona device 59 positioned downstream of the transfer device 58 serves to lessen the electrostatic attraction between the substrate 48 and the belt 10, and thereby facilitates stripping of the substrate 48 from the belt in the area of the stripping roller 14.

Fusing station F includes a fuser assembly indicated generally by the reference numeral 70, which permanently affixes the transferred toner powder image to the copy substrate. Preferably, fuser assembly 70 includes a heated fuser roller 72 and/or a pressure roller 74 with the powder image on the copy substrate contacting fuser roller 72. As the substrate 48 passes through fuser 70, the transferred toner images are permanently fixed or fused to the substrate.

After passing through fuser 70, a gate 80 either allows the substrate to move directly via output 84 to a finisher or stacker, or deflects the substrate into a duplex printing path 100-specifically, into single substrate inverter 82. That is, if the substrate is either a simplex substrate, or a completed duplex substrate having both side one and side two images formed thereon, the substrate will be conveyed via gate 80 directly to output 84. However, if the substrate is being duplex printed and has only been printed with a side one image, the gate 80 will be positioned to deflect that substrate into the inverter 82 and into the duplex loop path 100, where the 48 substrate will be inverted and then fed for recirculation back through transfer station D and fuser 70 to receive and permanently fix the side two image to a backside of that substrate before it exits via exit path 84.

After the print substrate 48 is separated from photoconductive surface 10, any residual toner/developer and paper fiber particles adhering to photoconductive surface 10 are removed therefrom at cleaning station E. Cleaning station E includes one or more rotatably mounted fibrous brushes or webs and/or a cleaning blade in contact with photoconductive surface 10 to disturb and remove paper fibers and non-transferred toner particles. The blade may be configured in either a wiper or doctor position, depending on the application. Subsequent to cleaning, a discharge lamp (not shown) floods photoconductive surface 10 with light to dissipate residual electrostatic charge remaining thereon prior to recharging for a successive imaging cycle.

As will be appreciated, the various machine functions are regulated by controller 29. The controller is preferably a programmable microprocessor that controls several or all of the machine functions hereinbefore described including toner dispensing. The controller provides a comparison count of the copy substrates, the number of documents being recirculated, the number of copy substrates selected by the operator, time delays, jam corrections, etc. Control of all of the exemplary subsystems and stations heretofore described may be accomplished by conventional control switch inputs from the printing machine consoles selected by the operator. Conventional substrate path sensors or switches may be utilized to keep track of the position of the document and the copy substrates.

It should also be appreciated that the disclosed system may be employed in a multi-engine xerographic system wherein the images are developed on a plurality of photoconductors as described above, and are transferred to an intermediate belt or to a print substrate. Alternatively, the disclosed method may be employed in other printing processes and is not specifically limited to the xerographic embodiments disclosed herein. For example, ink jet print engines may make use of a similar technique to adjust printing process parameters based on tracking of residual ink levels after a trans-fix or trans-fuse operation (non-direct-to-paper printing, where the image is built up on a drum or other substrate and then subsequently transferred to the paper). Accordingly, the method described herein may find practical application in various printing and reprographic embodiments.

A density sensor, such as an Extended Toner Area Coverage (ETAC) sensor 110, may be located downstream of the developer unit 38. Sensor 110 is used for controlling settings within the development, charging, and exposure subsystems. Non-limiting examples of such settings include development bias voltage, exposure/illumination power, and charging voltage/current or combinations thereof. Sensor 110 may be of a point type that senses developed mass per unit area (DMA) only. At some desired sampling interval, test patches may be output from the development system and measured by the ETAC point sensor. These DMA readings are then used in a feedback loop to adjust the settings in the development, charging, and exposure subsystems in an effort to maintain a developed mass output that is near a desired level.

In order to provide sensing of transfer defects, a residual mass sensor 120 is provided downstream of transfer station D, preferably prior to cleaning station E. Referring also to FIG. 2, in one embodiment, residual mass sensor 120 is a full width array (FWA) or other optical sensor having an array length L that spans substantially the entire effective width W of the photoconductive surface 10 (i.e., the portion 10A that is capable of being processed by the charging station A, exposure station B, and developer station C). In a preferred embodiment, sensor 120 is a photodiode array coupled with a lens array for focusing light reflected from the photoconductor surface onto the sensing elements, as well as an illumination source. The contact image sensor (CIS) model number SV 651A4C, available from Syscan, is an example of such a sensor. This sensor is constructed of a plurality of sensing elements (approximately 5184 over 232 mm) and provides approximately 600 samples per inch (SPI) resolution across the length of the bar. The sensor also provides an adjustable light-emitting diode (LED) illumination source capable of providing varying levels of red, green, and blue (RGB) illumination across the entire length of the sensor array. In one embodiment, the LED illumination source is used to direct light onto the photoconductor (or transfer web) surface in the post-transfer position. This incident light interacts (reflected/scattered and absorbed) with the photoconductor and the residual mass pattern, with the amount of light that is scattered versus reflected, being representative of the amount of residual mass that is present on the photoconductor surface. Some of the light that is reflected from the photoconductor and/or residual mass will reach the sensor and is gathered by the lens array and directed onto the array of sensing elements.

In one embodiment, the incident light from the illumination source and the photodetector array are aligned such that a completely specular reflection is obtained from the bare photoconductor surface (i.e. the incident light is reflected off the bare photoconductor at an angle intended to cause the reflected light to be directed into the photodetector array). This configuration assures that most of the reflected light will reach the photodetector array in the case of a bare photoconductor passing beneath the sensor. In this configuration, any residual toner present on the photoconductor surface will serve mostly to absorb or scatter the incident light and prevent it from reaching the sensor. Thus, the amount of mass present in a particular region of the photoconductor surface (or web surface) is inversely related to the amount of reflected light that a sensing element receives (with more light indicating less toner present and vice-versa).

Other modes of operation are also possible, depending on the desired illuminator/detector configuration. In one example, diffuse reflection (rather than the specular) from the photoconductor surface can be observed by the residual mass sensor. In another example contemplated by the present disclosure, transmissive light sensing may be employed where the photoconductor or the intermediate web (not shown) would permit some light to pass through the regions not having residual toner thereon.

In various embodiments, full-width array sensor 120 senses the residual mass left on a photoreceptor or other substrate surface after transfer at transfer station D. The sensor generates a two-dimensional image (linear array and moving belt or photoconductor) of the residual mass pattern or structure remaining on the photoconductive surface 10 to form a residual mass signature (or image).

In the illustrated example, there is only a single transfer step. However, as noted above, the disclosed system and method are not to be so limited. For example, in tandem engines, there may be at least two transfer steps. A first transfer is from the photoconductor surface to an intermediate web or substrate (typically a belt). After a series of successive (color) images are transferred to the intermediate belt, the entire composite image is then transferred to paper in a second transfer step. Accordingly, it may be desirable to sense residual mass patterns after any of the transfer steps in a xerographic process: for example sensing residual mass on the photoreceptors and/or on the intermediate belt in a two-step transfer system.

Figure 7A:
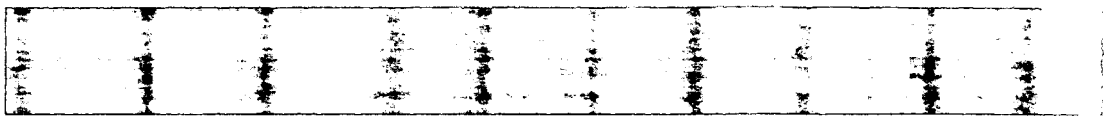
Figure 7B:
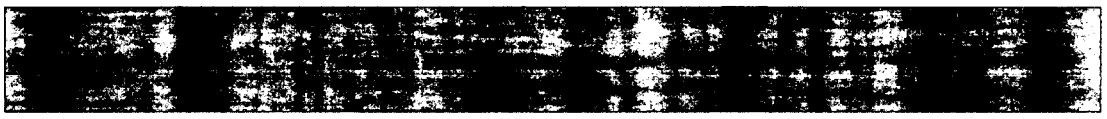
Figure 7C:
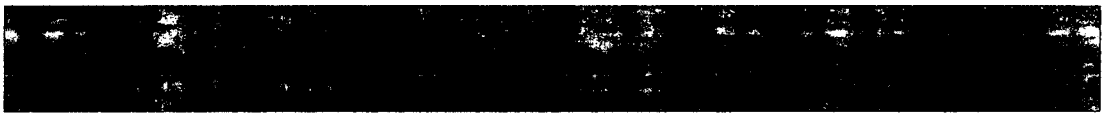

As described in the cross-referenced application noted above, predefined test targets are employed and captured images of the resultant residual mass patterns can be analyzed by appropriate signal processing or image analysis to identify and/or quantify the level of each type of a defect present on the photoconductive surface (e.g., see FIGS. 7A-7C). These identified defects and possibly their quantified levels can then be used as feedback in a closed-loop control system for the xerographic engine. This will enable improved performance and more robust control by taking into account identification of various types of transfer defects so that a customized and appropriate feedback correction can be made. That is, depending on the type of defect problem encountered, the control routine may be different even if the same average residual mass per unit area is present.

The disclosed embodiments are intended to satisfy a need for online residual mass sensing without being limited to a point sensor and without requiring the printing of special test or calibration pages or targets. Moreover, the techniques are capable of detecting changes in system performance over the course of a print job. Many of the problems that can effect image quality may arise during a print job. Even after a calibration procedure has been performed or a job proofing process conducted, disturbances that occur within the print job can still lead to significant image quality degradation. Some problems (e.g., development loss as a function of material age) manifest themselves over the course of long print jobs. Hence, even though the machine may be operating in a desirable region at the start of the job, the initial setup calibration cannot prevent the long term print quality loss.

Another example of within print job disturbances is a change in media or print substrate characteristics. It is well known that the porosity and resistivity of the paper used as a print-receiving substrate can affect the onset of a transfer induced point deletions. Media resistivity is a function of its environmental history, which may vary significantly throughout a long print job (especially in a duplex printing job where previously fused pages are run through the transfer station). In this case, slow drifts in the media resistivity as the print job is being run can significantly affect the presence or absence of transfer induced point deletions—and, accordingly, where the optimal set points are for the transfer subsystem. There are many other aspects of xerographic marking engines that can change over the course of a long print job and affect output print quality. In light of the fact that disturbances such as material age and media properties can occur within the print job and can significantly affect print quality, it is believed desirable to have a system and method capable of measuring residual mass within the print job.

It is also possible that the stress regions of a printed page (from a transferability point of view) may not even be sensed or controlled by conventional point sensing systems. In conventional devices, it may be that print quality is interpreted to be fine while in fact a loss in transfer efficiency is causing print quality degradation in other areas of the page. The level of transfer stress for different regions of the paper is dependent on factors such as the local media properties (which are known to vary across the page), the local toner charge distributions (which can vary significantly if different colors are used in different regions), and the local toner mass distributions (which are strongly affected by image content, e.g., number of layers and color content of different regions). In addition, the required control action depends on more than simply average residual mass in a given region since various transfer defects can result in the same $RMA_{avg}$ reading.

Figure 3:
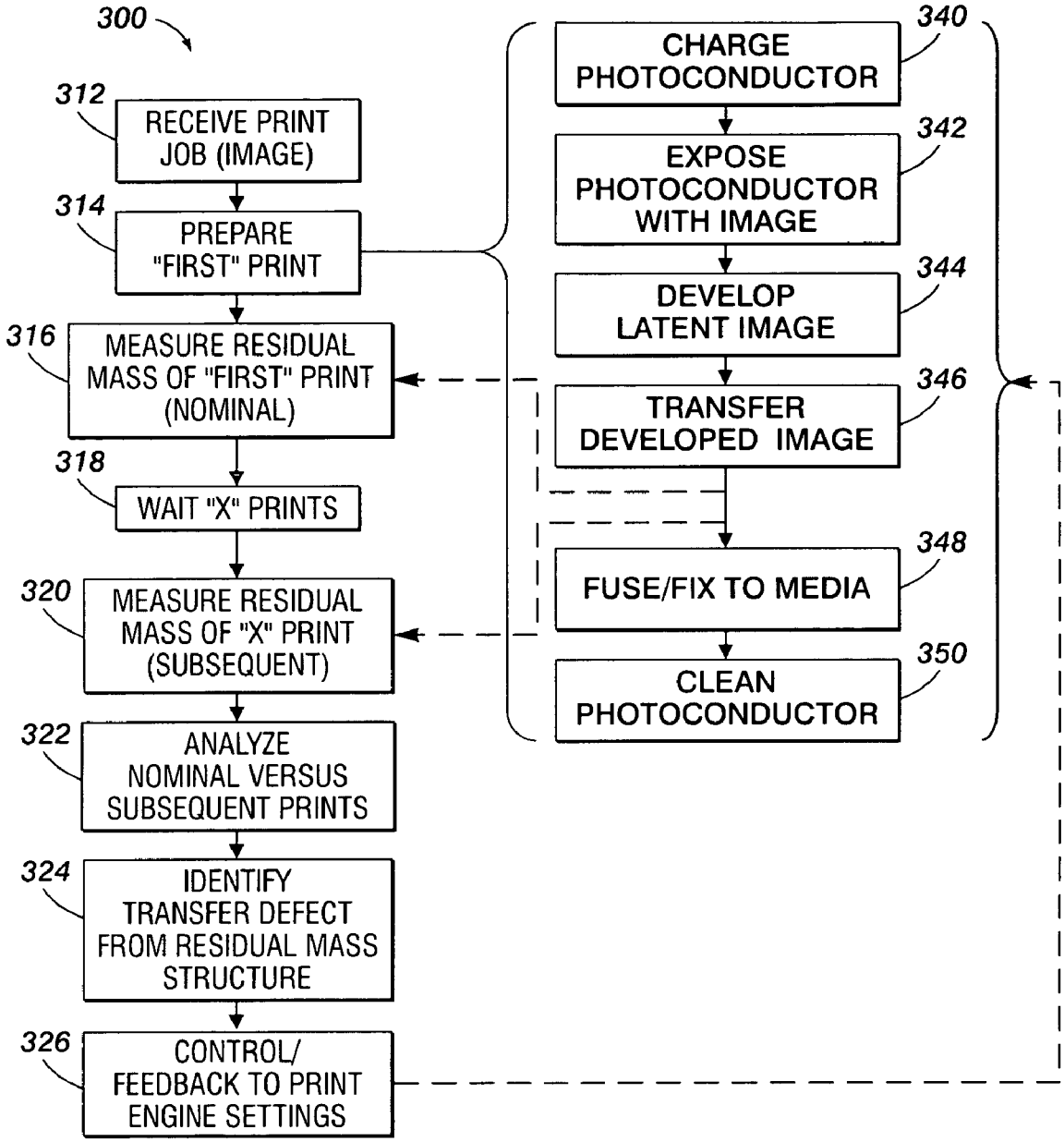
FIG. 3 is a flowchart illustrating an exemplary embodiment of the disclosed method for residual mass sensing using print job images.

Referring also to the general flowchart of FIG. 3, as will be appreciated, the use of an optical sensor to measure residual mass during a print job can be complicated by the fact that the residual mass changes structure based on the image content of the prints. Accounting for this with the residual mass sensor could require knowledge of the digital input image and/or the developed mass image as well as intimate knowledge of the spatial transfer function of the print engine (i.e., how the engine will affect the digital input image and/or the developed mass image with the result being the expected residual mass signature). In order to eliminate the need for knowledge of the input digital image, the developed mass image, or the spatial transfer function of the print engine, sensing method 300 is proposed. This method involves receiving a print job image (312), preparing the job for printing 314 and then printing the image on the xerographic engine (340, 342, 344, 346, 348 and 350 and stations A-F as earlier described). During printing capturing the nominal operating point at the start of the print job (capturing the residual mass images for this initial case) is accomplished at 316. As the customer job is being printed, subsequent images are then captured at an appropriate rate (related to the time constants of the types of disturbances that are of interest), as represented by the wait step 318. For example, if a known defect arises only in jobs where at least two-hundred successive prints are transferred, then step 318 may wait on the order of two hundred prints (cycles 340-350) before a subsequent residual mass measurement is made, 320.

These subsequent images are then compared to the original, nominal residual mass images and an error image is generated at 322. The error image provides information as to how much the residual mass levels within a page have drifted since the start of the print run as well as any defects identified, step 324. Using the error image or difference measurement, corrective actions can be taken within the print engine, control/feedback 326 in an effort to minimize degradation in print quality. For instance, closed loop control of transfer could be implemented wherein the change in the residual mass structure is used as feedback to a controller that will then appropriately adjust the transfer current set point to minimize increases in the residual mass (as compared to the original performance levels).

Figure 4:
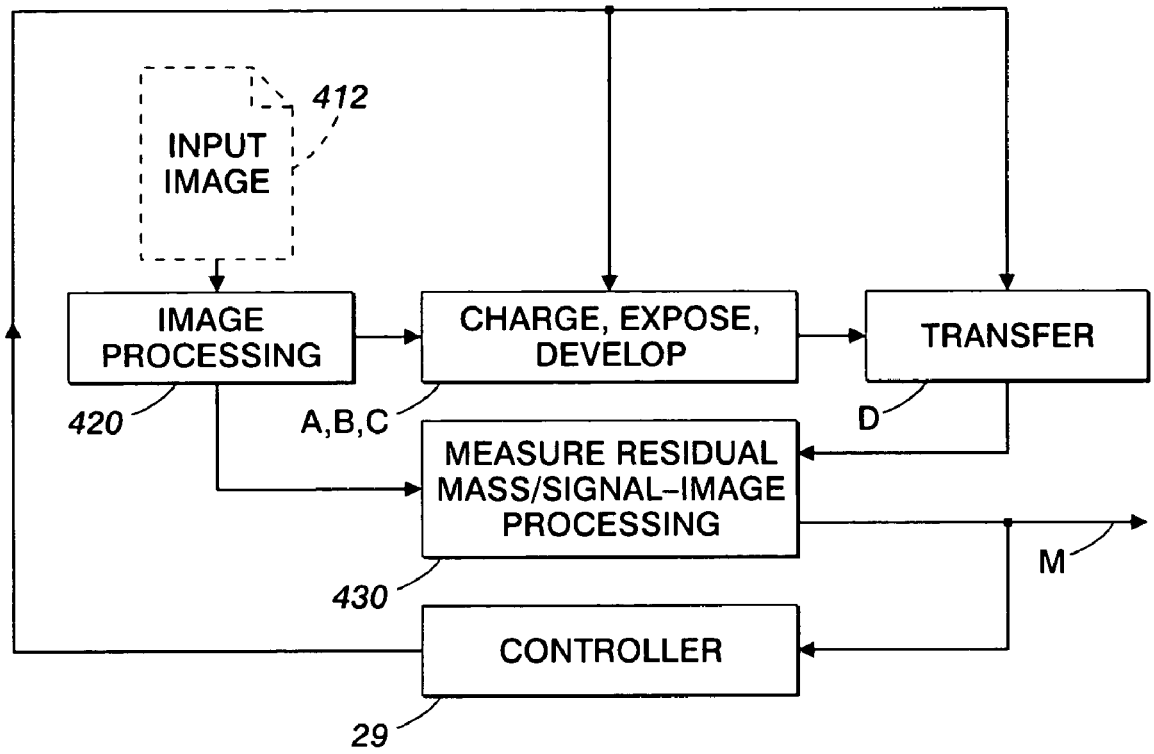
FIGS. 4 and 5 are illustrative examples of a control system in which aspects of the disclosed method may operate.
Figure 5:
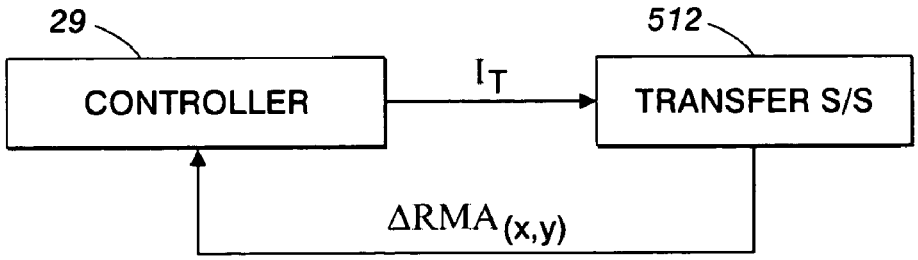

Diagrams of the control scheme employed herein are also depicted in FIGS. 4 and 5, where the customer's input image 412 is first image processed (420) through an imaging path, followed by the charging, exposure and development operations (A, B, C) described in detail above. The developed image is then transferred (D) and the two dimension residual mass signature (or residual mass image RMI) measured. As described previously, the output of transfer is an unfused print and some residual mass remaining on the photoconductive belt (or intermediate web), both of which may indicate or contain a defect. Based on the correlation between output print defect and residual mass, it can be assumed that the residual mass signature will carry a characteristic of the output defect and can be used to detect and potentially to quantify such defects. Thus, the residual mass containing a defect can be sensed by a 2-dimensional residual mass sensor (corresponding to sensor 120 in FIG. 2) to obtain a two-dimensional residual mass signature and to detect the defect. Once measured, a ΔRMI(x,y) is determined, where ΔRMI(x,y) is intended to represent the 2-dimensional difference image for the "subsequent" image (as contrasted to the nominal residual mass image $RMI_{nominal}$ (x,y)).

The residual mass signature can be fed to a signal processing circuit or software 430 to detect particular types of transfer defects or as set forth below to characterize and quantify the level of change in the residual mass signature as compared to the nominal case. Signal processing circuit or software 430 can then output a reduced vector of print quality metrics (M) to controller 29. It will be appreciated that controller 29 may be the controller previously described relative to system 9, or may be an independent controller designed specifically for the task. Controller 29 can then adjust subsequent operation of the print engine of FIG. 1 in a closed-loop fashion based on the metrics to compensate for changes in the residual mass signature.

An example of a simple control algorithm that may be employed to implement the control scheme described herein would be:

$$I_T(k)=I_T(k-1)+K_C*\Delta RMA_{AVG}(k-1) \quad \text{Eq. (1)}$$

In this equation, $\Delta RMA_{AVG}$ is a reduction of the ΔRMI (x,y) error image to a single number through an averaging process, and the variable 'k' is the sample index. If it is assumed that the residual mass sensor is sampled and the transfer current set point updated on a page-to-page basis, then equation (1) suggests that the transfer current ($I_T$) for the present sheet is simply the transfer current setting from the previous sheet adjusted by a weighted version of the increase in average RMA from the nominal case. $K_C$ represents a controller gain parameter that can be tuned to give the desired response. An important factor in the design of the controller gain will also be the amount of noise in the ΔRMI measurement. A large controller gain may be beneficial from the standpoint of dynamic response, but will also tend to amplify the contribution of the measurement noise. Thus, the process of tuning the controller gain must account for both desired transient response as well as noise sensitivity. Other, more complex controller designs could also be implemented in order to obtain the desired system behavior.

Although the method represented in equation (1) reduces the image data to a single number, this method still has an advantage over an ETAC or other point sensor approaches because more information is being considered in the calculation of the Δ value. Changes in transfer efficiency at any location in the page will affect the Δ value, whereas with an ETAC sensor, only those points that lie along a line of sight of the ETAC (a single strip along the process direction) will affect the measurement.

Other methods for using the error image data could also be utilized. For example, it is further contemplated to partition the image into smaller squares and processing the information within each square independently. This would produce a set of average ΔRMA values across the page, as represented by the following equation:

$$\Delta RMA_{AVG} = \begin{bmatrix} \Delta RMA_{AVG,1} \\ \Delta RMA_{AVG,2} \\ \vdots \\ \Delta RMA_{AVG,N} \end{bmatrix}, \quad \text{Eq. (2)}$$

This vector represents a measure of the average transfer efficiency in N different regions of the customer image. Many different control approaches could be taken with this set of information. For example, an algorithm could be used whereby the worst-case transfer efficiency value was selected out of this vector. The controller algorithm could then be constructed as follows:

$$I_T(k)=I_T(k-1)+K_C*\Delta\mathrm{RMA}_{AVG(Worst)}(k-1) \quad \text{Eq. (3)}$$

The disclosed technique of measuring the change in residual mass signature from the nominal case throughout the customer print job may also be coupled with an initial setup calibration. Here the setup calibration would be used to ensure that the initial prints were of maximum quality—perhaps as part of a proofing operation as suggested previously. The system would then provide a mechanism for measuring residual mass levels on-the-fly throughout the job without requiring the printing of further test prints and without the restrictions of a point sensor. It is believed that such a system would give a clearer picture of what was happening to the transfer efficiency throughout the job because it is guaranteed that sufficient information passes below the sensor to provide valid information (measuring the entire page rather than a single strip as the ETAC does).

The various embodiments disclosed herein contemplate the elimination of the need for test targets, using instead, the residual mass sensing and tracking over a plurality of successive cycles where deviation or change from a nominal or early residual mass is tracked.

Figure 6:
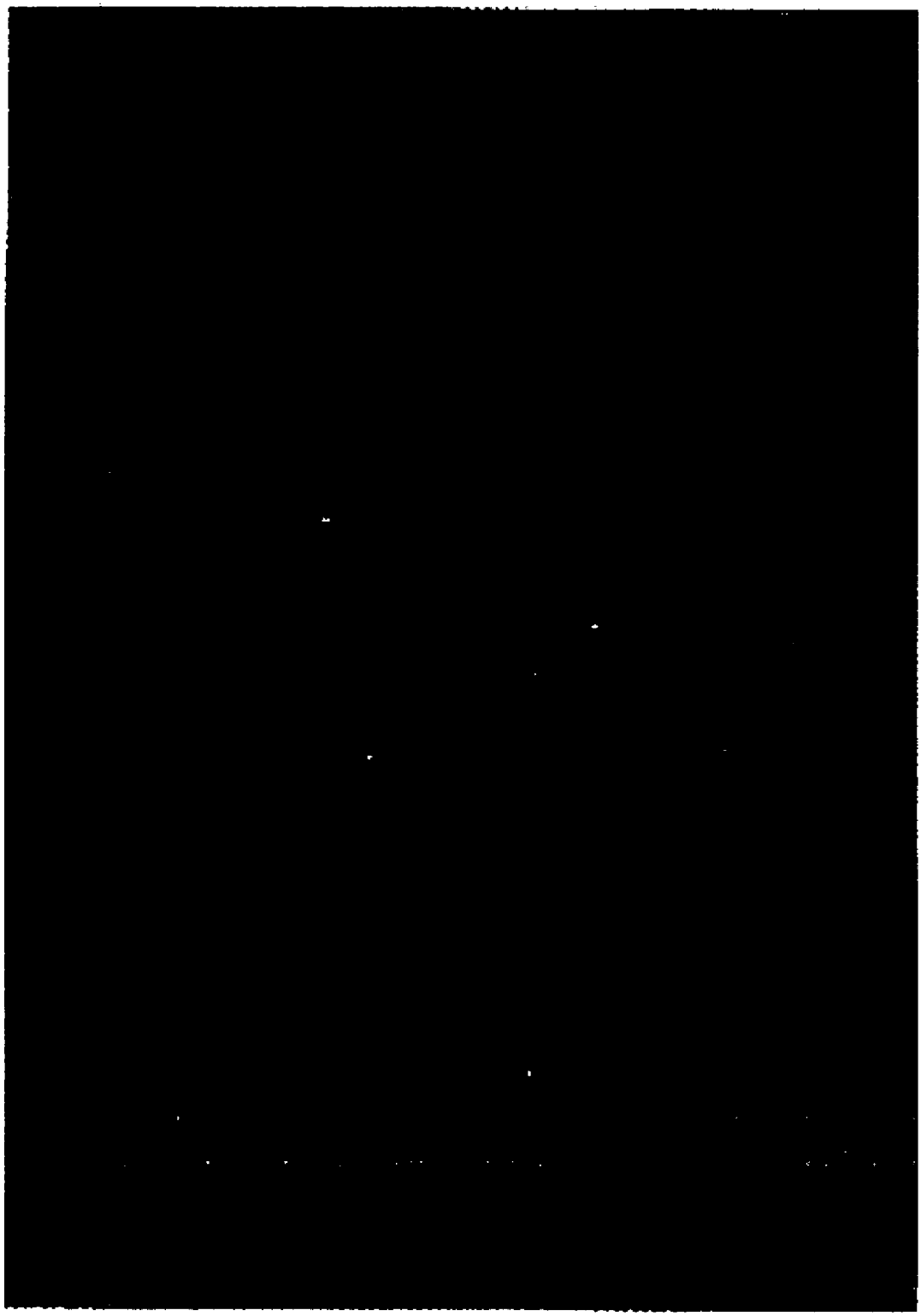
FIGS. 6 and 7A-7C are illustrative examples of defects that may be identified in accordance with aspects of the disclosed method and system.

Illustrated in FIG. 6, for example, is a representation of a defect known as "transfer induced point deletions" or just "point deletions." For purposes of illustration, these defects are illustrated in a black patch. In some xerographic embodiments, the point defect occurs infrequently during a job and may result in the need to inspect/sort the output prints looking for the point deletions. An advantage of the approach described herein is that these defects would be detectable on-the-fly without any offline inspection. It will be further appreciated that the detection of defects may also lead to the generation of signals in order to permit the automatic ability to divert print sheets that are identified as containing certain levels of defects (as opposed to only using the residual mass signature information to adjust machine controls or settings to eliminate identified defects).

Considering, also, FIGS. 7A-7C, these figures are representative samples of residual mass images showing streak defects. Here again, the disclosed system and method may be employed to not only generate an image of the defects, or a difference image employed to identify defects, but may also be used to provide further information for the determination of the type of residual mass defect sensed. Note that illustrations in FIG. 7A-7C are the actual residual mass image scans and are not difference images as described previously.

As described, the various embodiments use a full-width array sensor or similar image acquisition circuitry to measure residual mass from print jobs or customer images while they are being printed. In order to simplify the problem of sensing residual mass signatures from an unknown image source such as a customer's image, the following measurement technique would be employed. First, a nominal residual mass image is captured at the start of the customer job. Such an image may be generated from either the first few pages of a print job or during the "proofing mode" for the job. Subsequently, during the course of completing the print job, subsequent residual mass images are captured and compared to the original set of images. More specifically, the comparison looks at or creates a difference image between the nominal and subsequent images. Large deviations in residual mass levels, as measured in the difference image, would indicate transfer problems such as a loss of transfer efficiency in particular regions of the print.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for identifying transfer defects in a document rendering system, comprising:

sensing, after image transfer, a nominal residual mass structure on a surface corresponding to a portion of a document rendered within the system;

sensing, after image transfer, a subsequent residual mass structure on the surface corresponding to a similar portion of the same document rendered within the system;

analyzing the difference between the nominal residual mass structure and the subsequent residual mass structure; and detecting a transfer defect, or set of defects, based on the analysis of the difference in residual mass structures.

2. The method of claim 1, wherein the system is a xerographic system and where the surface comprises a photoreceptor.

3. The method of claim 2, wherein the xerographic system includes a plurality of photoreceptors that transfer developed images to an intermediate transfer belt and where the surface comprises an intermediate transfer belt.

4. The method of claim 1, where the step of analyzing the difference between the nominal residual mass structure and the subsequent residual mass structure includes a two-dimensional analysis using signal processing techniques.

5. The method of claim 1, wherein the sensing is performed using an optical array sensor and where the portion of the document is selected from substantially an entire width of the surface.

6. The method of claim 5, wherein analyzing the difference between the nominal residual mass structure and the subsequent residual mass structure, comprises comparing a nominal residual mass image generated from the optical array sensor with a subsequent residual mass image to generate an error image.

7. The method of claim 6, wherein the error image is employed to adjust a transfer current set point to control the residual mass.

8. The method according to claim 1, wherein the defect includes a transfer induced point deletion defect.

9. The method according to claim 8, further comprising providing feedback to the system to adjust a subsequent printing operation based on the defect detected.

10. The method according to claim 9, wherein the adjustment to the system is a function of the quantified level of the transfer defect.

11. The method according to claim 9, wherein the adjustment includes identifying an output print with which the defect was associated.

12. A xerographic output device, comprising:

a controller that receives an image signal representing an image to be printed;

a photoconductive surface;

a charging station that charges the photoconductive surface to a relatively high potential;

an exposure station that receives image signals from the controller and records an electrostatic latent image on the photoconductive surface;

a development station that deposits toner over the electrostatic latent image on the photoconductive surface to form a toner image;

a transfer station that transfers the toner image from the photoconductive surface to a recording medium;

a residual mass sensor that senses a nominal residual mass signature after image transfer and a subsequent residual mass signature, and a processor, that receives the nominal residual mass signature and subsequent residual mass signature and determines a difference between the nominal and subsequent residual mass signatures to indicate a transfer defect.

13. The xerographic output device of claim 12, wherein residual mass sensor outputs a two-dimensional residual mass structure signature of any residual mass remaining on the photoconductive surface useful to determine and quantify specific image transfer defects, the residual mass sensor being located adjacent the photoconductive surface downstream from the transfer station in a process direction and being capable of sensing a substantial portion of the photoconductive surface.

14. The xerographic output device of claim 13, further comprising feedback control that adjusts at least one operating parameter of the xerographic output device based on the specific transfer defect detected.

15. The xerographic output device of claim 14, wherein the adjustment to the xerographic system is a function of on the quantified level of the transfer defect.

16. The xerographic output device of claim 14, wherein the feedback control adjusts the operation of at least one processing station upstream from the transfer station.

17. The xerographic output device of claim 16, wherein the upstream processing station is selected from the group consisting of: the charging station, the exposure station, the development station, and an image path.

18. The xerographic output device of claim 12, wherein said processor includes a signal processor that detects a transfer defect based on a residual mass difference image.

19. A method for identifying transfer defects in a xerographic system, comprising:

receiving an image signal for rendering;

charging a photoconductive surface;

exposing the charged photoconductive surface to produce a latent image thereon;

developing the latent image on the photoconductive surface;

transferring the developed image to a substrate;

sensing, after image transfer, a nominal residual mass structure on a surface corresponding to a portion of a document rendered within the xerographic system;

repeating the steps above and subsequently sensing, after image transfer, a subsequent residual mass structure on the surface corresponding to a similar portion of the same document rendered with the xerographic system;

analyzing the difference between the nominal residual mass structure and the subsequent residual mass structure; and detecting a transfer defect based on the analysis of the residual mass structure.

20. The method of claim 19, wherein the substrate is an intermediate transfer web, further comprising:

receiving the developed image on a transfer web;

subsequently transferring the developed image from the transfer web to an output substrate; and causing the developed image transferred to the output substrate to be permanently affixed thereto.

* * * * *